US010228223B1

(12) United States Patent
Hardt et al.

(10) Patent No.: US 10,228,223 B1
(45) **Date of Patent: *Mar. 12, 2019**

(54) COOK-OFF MITIGATION SYSTEMS

(71) Applicant: The United States of America, as represented by the Secretary of the Navy, Washington, DC (US)

(72) Inventors: Lee R. Hardt, Ridgecrest, CA (US); Donald L. Burnett, Spearfish, SD (US); Josiah S. Garfield, Ridgecrest, CA (US); Robert A. Koontz, Anchorage, AK (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/938,518

(22) Filed: Mar. 28, 2018

Related U.S. Application Data

(62) Division of application No. 15/380,679, filed on Dec. 15, 2016, now Pat. No. 10,101,139.

(51) Int. Cl.

| | |
|---|---|
| ***F42B 39/14*** | (2006.01) |
| ***F42B 39/20*** | (2006.01) |
| ***F42C 19/02*** | (2006.01) |
| ***F42B 12/20*** | (2006.01) |
| ***F42B 12/22*** | (2006.01) |

(52) U.S. Cl.
CPC ..... *F42B 12/207* (2013.01); *F42B 12/20* (2013.01); *F42B 12/22* (2013.01); *F42B 39/14* (2013.01); *F42B 39/20* (2013.01); *F42C 19/02* (2013.01)

(58) Field of Classification Search
CPC ..... F42B 12/00; F42B 12/02; F42B 12/20; F42B 12/207; F42B 12/22; F42B 39/14; F42B 39/20; F42C 19/00; F42C 19/02
USPC ..... 102/481
See application file for complete search history.

(56) References Cited

U.S. PATENT DOCUMENTS

| | | | | |
|---|---|---|---|---|
| 4,615,272 | A * | 10/1986 | Aubert | F42B 12/80 102/331 |
| 5,786,544 | A * | 7/1998 | Gill | F42B 39/20 102/293 |
| 5,959,235 | A * | 9/1999 | Wagstaff | F02K 9/38 102/202 |
| 6,615,737 | B2 * | 9/2003 | Bonnel | C06B 45/00 102/202.1 |
| 6,752,085 | B2 * | 6/2004 | Roach | F42B 39/14 102/481 |
| 7,472,653 | B1 * | 1/2009 | Hays | F42B 39/20 102/481 |
| 9,476,683 | B2 * | 10/2016 | Marchais | F42B 25/00 |
| 9,810,513 | B2 * | 11/2017 | Kerns | F42B 12/204 |

(Continued)

FOREIGN PATENT DOCUMENTS

| | | | | |
|---|---|---|---|---|
| EP | 2863165 | A1 * | 4/2015 | F42B 8/16 |
| WO | WO-2008096069 | A1 * | 8/2008 | F42B 12/04 |

*Primary Examiner* — James S Bergin
(74) *Attorney, Agent, or Firm* — James M. Saunders

(57) ABSTRACT

Embodiments of the invention are directed to enhancing insensitive munitions performance. Some embodiments of the invention employ an outgassing pad having unique geometrical configurations and positioning. Other embodiments rely on using thermally-releasable components to foster billet expulsion. Additional embodiments combine both aspects into an entire cook-off mitigation system.

15 Claims, 7 Drawing Sheets

(56) References Cited

U.S. PATENT DOCUMENTS 10,088,285 B1 * 10/2018 Hardt ..... F42B 12/207
10,101,139 B1 * 10/2018 Hardt ..... F42B 12/207

* cited by examiner

COOK-OFF MITIGATION SYSTEMS

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

Embodiments of the invention generally relate to insensitive munitions.

Figure 1:
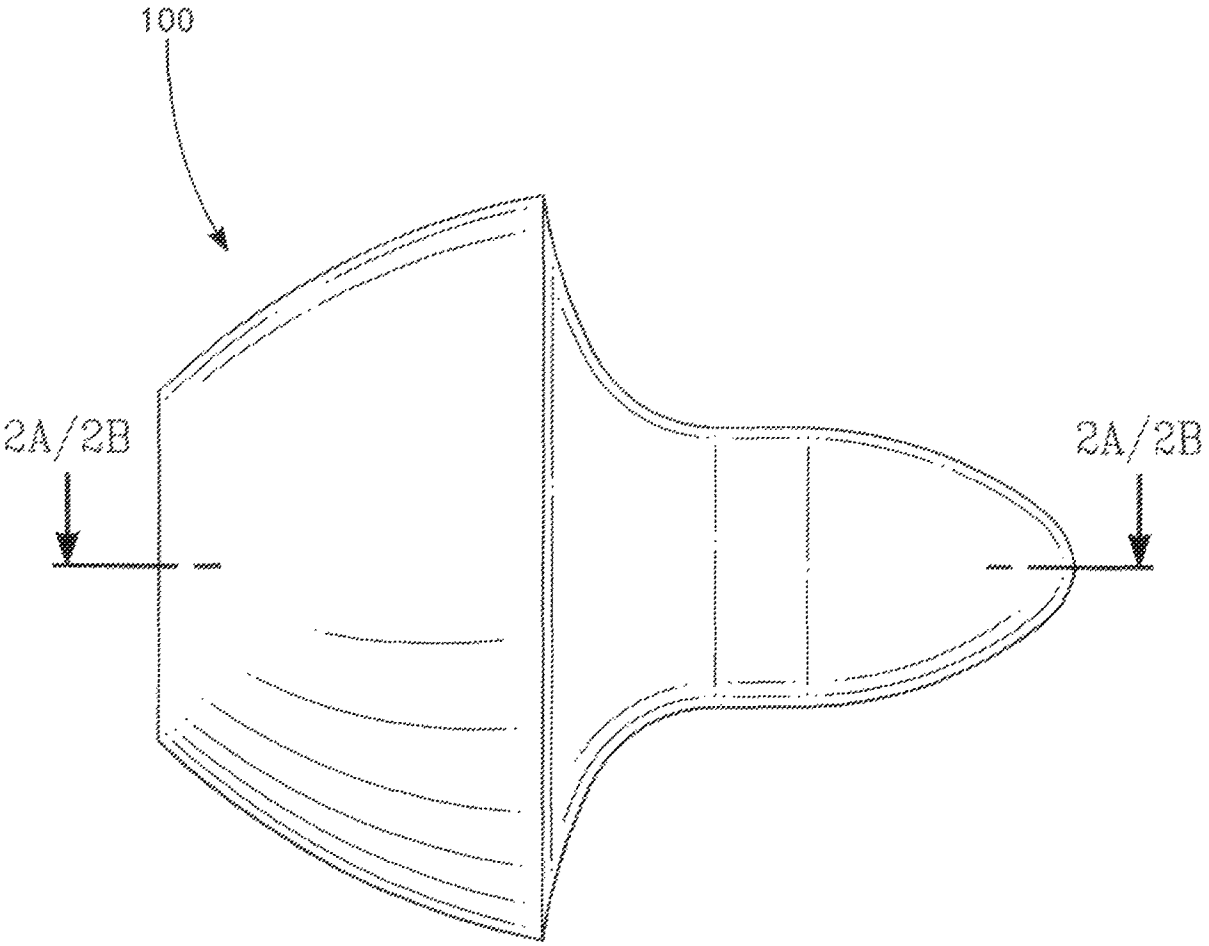
FIG. 1 is a side view of an outgassing pad, according to some embodiments of the invention.

It is to be understood that the foregoing general description and the following detailed description are exemplary and explanatory only and are not to be viewed as being restrictive of the invention, as claimed. Further advantages of this invention will be apparent after a review of the following detailed description of the disclosed embodiments, which are illustrated schematically in the accompanying drawings and in the appended claims.

DETAILED DESCRIPTION OF EMBODIMENTS OF THE INVENTION

Embodiments of the invention generally relate to insensitive munitions (IM) improvements, especially with respect to cook-off mitigation systems. Some embodiments of the invention employ an outgassing pad in the nose of the munition. Additional embodiments employ a releasable (two-part) charging well. Further embodiments combine these approaches with a releasable tail closure mechanism.

Although embodiments of the invention are described in considerable detail, including references to certain versions thereof, other versions are possible such as, for example, orienting and/or attaching components in different fashion. Therefore, the spirit and scope of the appended claims should not be limited to the description of versions included herein.

Components and Materials Used

In the accompanying drawings, like reference numbers indicate like elements. Reference characters 100, 400, and 500 are used to depict various embodiments of the invention. Several views are presented to depict some, though not all, of the possible orientations of embodiments of the invention. Some figures depict section views and, in some instances, partial section views for ease of viewing. The patterning of the section hatching is for illustrative purposes only to aid in viewing and should not be construed as being limiting or directed to a particular material or materials.

Components used in several embodiments of the invention, along with their respective reference characters, are depicted in the drawings. Reference character 100 depicts an outgassing pad. In some embodiments, the outgassing pad 100 includes a shell 102 and an outgassing agent 104, such as a powder and binder mix. The shell 102 can be an elastomeric shell such as silicone, rubber, or silicone-rubber. The outgassing agent 104 is a powder and binder mix. The elastomeric shell 102, may also be referred to as an outgassing shell, container, or bladder, and can be used to house the outgassing agent 104 as a technique for controlled fragmentation, enhanced gas containment, and as a reduction in compatibility concerns. A person having ordinary skill in the art will recognize the term compatibility concerns to be synonymous with assuring that chemicals coming in contact with an explosive fill are chemically compatible.

In other embodiments, the shell 102 can be a non-elastomeric shell such as plastic. In yet other embodiments, the shell 102 can be eliminated. In embodiments without a shell 102, the outgassing pad 100 is the outgassing agent 104, as discussed further below.

The surface contours of the outgassing pad (reference character 100) with a shell (reference character 102) as well as the outgassing pad without the shell are the same. Section views best illustrate the outgassing pad 100 embodiments. Generically, the outgassing pad is depicted with reference character 100. Reference character 100A is used to depict the section view of an outgassing pad with a shell, as shown in FIG. 2A. The embodiment in FIG. 2A can also be referred to as a confined or canistered outgassing pad 100A. Conversely, as shown in FIG. 2B, reference character 100B depicts the section view of an outgassing pad without a shell, and can be referred to as an unconfined or uncanistered outgassing pad.

The shell 102 has unique geometrical configurations, including surface contours having a sigmoid shape, ogee shape, or a cyma recta shape. A person having ordinary skill in the art will recognize that ogee and cyma recta are understood to be types of sigmoid shapes. A person having ordinary skill in the art will recognize that a sigmoid shape is a shape similar to the letter S. Likewise, a person having ordinary skill in the art will recognize that an ogee shape is descriptive of an S-shape and, moreover, is characteristic of two curves meeting at a point. Additionally, a person having ordinary skill in the art will recognize that a cyma recta shape is descriptive of double curvature, combining both convex and concave features. A person having ordinary skill in the art will also recognize, after viewing FIG. 2A, that the shell 102 can have a first portion 210A that is characteristic of a rounded trapezoid, truncated ogive or truncated ogival shape, and a second portion 212A that is sigmoid-shaped, ogee-shaped, or cyma recta-shaped. Likewise, the first portion 210A can also have a meplat shape. A person having ordinary skill in the art will recognize that the word meplat is used in ballistics and is a technical term for a flat or open tip on the nose of a bullet. The selected shapes are based on reducing stress concentration during obturation and also shock wave focusing during target penetration.

Figure 2B:
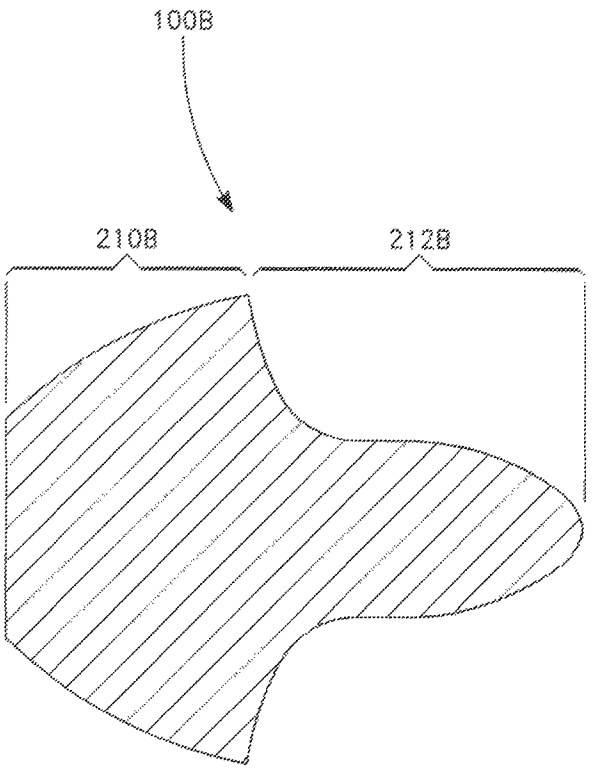
FIG. 2B is a section view of an outgassing pad without a shell, according to some embodiments of the invention.
Figure 2A:
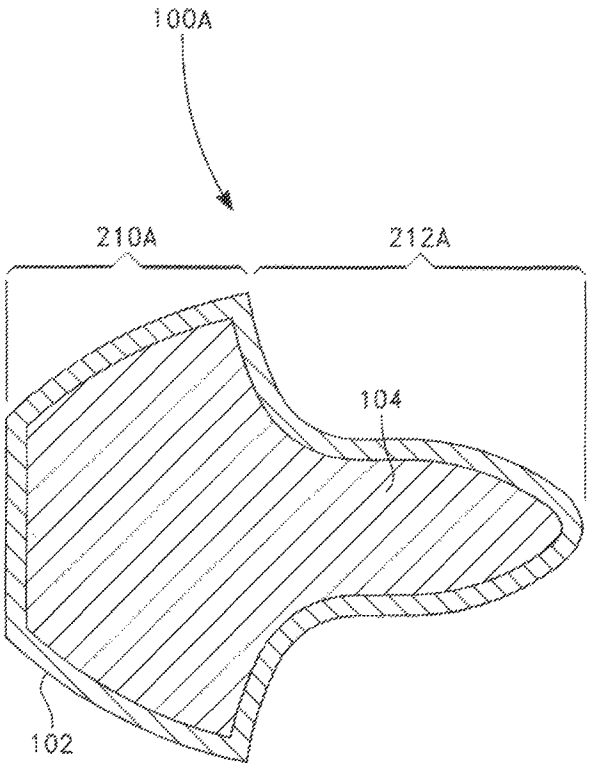
FIG. 2A is a section view of an outgassing pad with a shell, according to some embodiments of the invention.

Likewise, the surface contour shapes are also applicable to the embodiment depicted in FIG. 2B by reference characters 100B, 210B, and 212B. Specifically, the outgassing pad without the shell (reference character 100B) can also have a first portion 210B that is characteristic of a rounded trapezoid, or meplat, truncated ogive, or truncated ogival-shape, and a second portion 212B that is sigmoid-shaped, ogee-shaped, or cyma recta-shaped. The selected shapes are based on reducing stress concentration during obturation and also shock wave focusing during target penetration.

Selection of the outgassing agent 104 is based on several factors including volume-to-mass ratio of decomposition products, activation temperature, compatibility and stability, cost, material availability, and environmental concerns. The outgassing agent 104 is a powder binder mix. Suitable powders for the outgassing agent 104 include calcium formate and potassium formate. Suitable binders for the outgassing agent 104 include wax, tar, and an energetic binder. Additionally, a molding powder can be used in conjunction with calcium formate or potassium formate for pressing the outgassing pad 100 into its configuration. Also, instead of using an outgassing agent 104, a blowing agent such as Oxydibenzenesulfonyl Hydrazide (OBSH) can be used due to its cell structure.

Calcium formate is sometimes used as a food additive. Potassium formate has been identified as an environmental friendly alternative for deicing roads. In the unconfined embodiment (100B in FIG. 2B), the outgassing pad 100 is an outgassing agent 104 held in a specific geometry by incorporating a binder. In other embodiments, the outgassing pad 100 is a shell 102 that houses the outgassing agent 104. In still other embodiments, the outgassing pad 100 is the shell 102 housing the outgassing agent 104 mixed with a binder and sometimes referred to as a powder-binder mix. Binder choices include wax, tar, and an energetic binder. Binder formation includes melt cast methods for waxes, cast-curing from a mold, and press-molding for the powder-binder mixes. Future research efforts on outgassing agents include exploring the use of blowing agents, which are materials used in the production of a cellular structure through a foaming process in polymers, plastics, and metals.

Thus, in some embodiments, the elastomeric shell 102 can be eliminated by mixing the outgassing agent's 104 powder (calcium formate or potassium formate) with a binding agent such as, for example, asphaltic hot mix or Epolene wax. The mixture allows for the application of the outgassing agent (and hence the outgassing pad 100B) and binder to be applied directly to the wall of the munition 502 as a liner.

The powders in the outgassing agents 104 will compact appreciably during target penetration, which is undesirable. Adding the binder to create a powder-binder mix eliminates this concern because the binder fills the void spaces between the particles of the powder which constitutes the powder, thus reducing the compaction. The mixture of the powder-binder is determined based on application-specific conditions. In some embodiments, the powder (calcium formate or potassium formate) is a range of about 66 to about 68 percent and the binder is 30 percent. The variation in constituents is from varying percentages of additive(s) used to tune the peak exothermal temperature.

Instances having different ranges are also possible and can be dependent on the processing of the material such as particle size, particle geometry, packing fraction, and wettability. Additionally, the cost of manufacturing/processing the material can drive one process over another which can correspondingly change the requisite ranges. Based on this, in other embodiments, the range is about 60 percent to about 70 percent powder, and a binder range of about 30 to about 40 percent, with the remaining constituents being additive(s) used to tune the peak exothermal temperature. Likewise, when tuning the powder-binder mix to expel a munition's explosive billet, the unique characteristics of that specific munition can drive the percentages. As such, a larger/different range can be beneficial in addressing the maintaining of the mass properties of a munition system by adjusting the powder-binder mixture to closely match the density of the munition's main explosive billet, thus avoiding changes to flight or performance characteristics.

Reference character 400 depicts a charging well that employs a charging well cavity 402, charging well component(s) 408, fasteners 410, and a charge well bottom 406. The charging well components(s) 408 are generically depicted because the embodiments of the invention are applicable to a variety of charging well components without detracting from the merits or generalities of embodiments of the invention. Additionally, a person having ordinary skill in the art will recognize the specific components used in charging wells. Suitable materials for the fasteners 410 include plastic. The charge well bottom 406 is a structural material and, in most embodiments, is steel, aluminum, or plastic. A protective liner 411 is shown in some embodiments. Suitable liner materials include asphaltic hot melt, wax coating, and plastic.

Reference character 500 depicts a cook-off mitigation system in a generic munition 502. In addition to the outgassing pad 100 and charging well 400, the system 500 includes a munition casing 504 with an interior wall 506 defining at least one interior compartment configured to house an explosive fill 508. The interior wall 506 is the interior surface of the munition casing 504. As such, reference character 506 is used herein for both the interior wall and the interior compartment since the interior wall defines the interior compartment. At times the explosive fill 508 is referred to as an explosive billet or simply as an explosive without detracting from the merits or generalities of embodiments of the invention. Conduit 518, such as steel, can be used to house wires transmitting power or signals between the charging well 400 and a fuze well 511. The fuze well 511 is also steel. References to the use of steel herein also include steel alloys. A releasable tail closure mechanism 512 includes a base plug 514 and releasable base plate 516.

Figure 5:
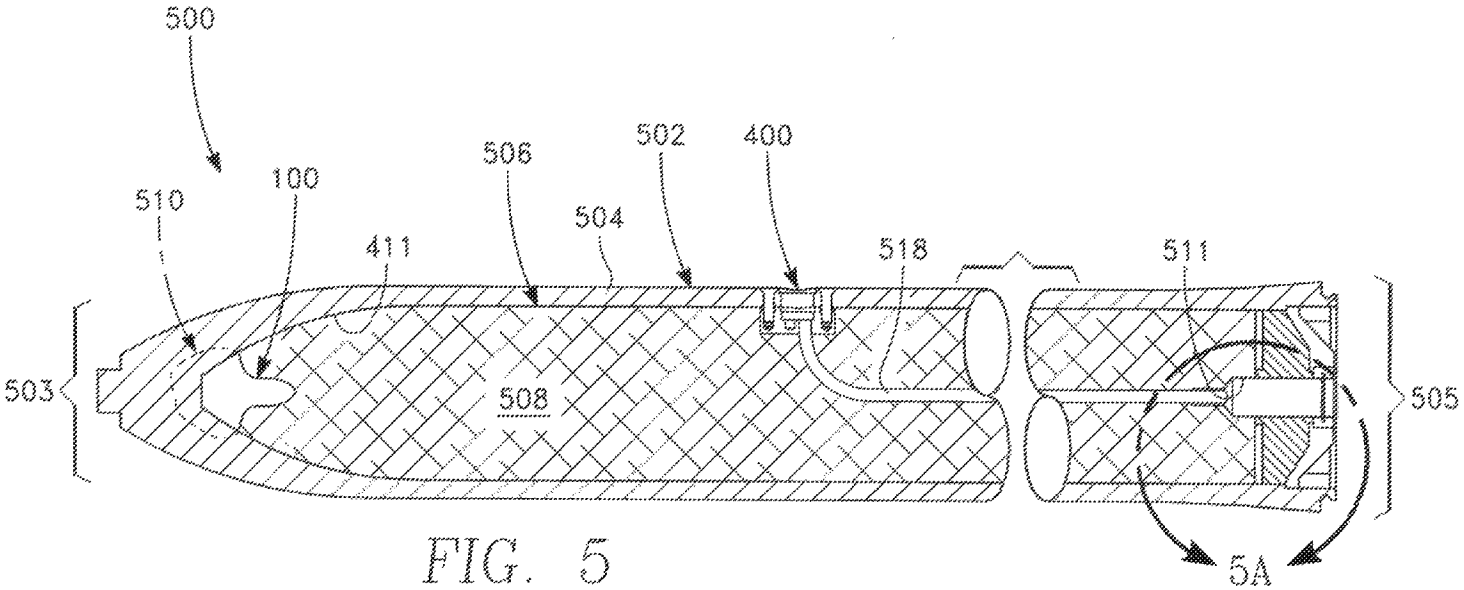
FIG. 5 is a partial section view of an outgassing mitigation system in a generic munition, according to some embodiments of the invention.

Additional components are shown for orientation purposes and to assist in understanding operating environments. In particular, FIG. 5 is very useful for illustrating an operating environment for several of the features employed in embodiments of the invention. A synthetic felt pad 520 is generically shown and can be used in some munitions to provide ullage space, but is not needed in all munitions. Sealant 522 is also generically shown, and is used to prevent slumping of the explosive billet 508 during curing in some, but not all munitions. A steel fuze well retaining ring 524 assists in securing the fuze well 511 to the munition casing 504. Eutectic devices 412 & 516, such as eutectic retaining nuts, are used and are discussed in greater detail below.

Apparatus and System Embodiments

Figure 3A:
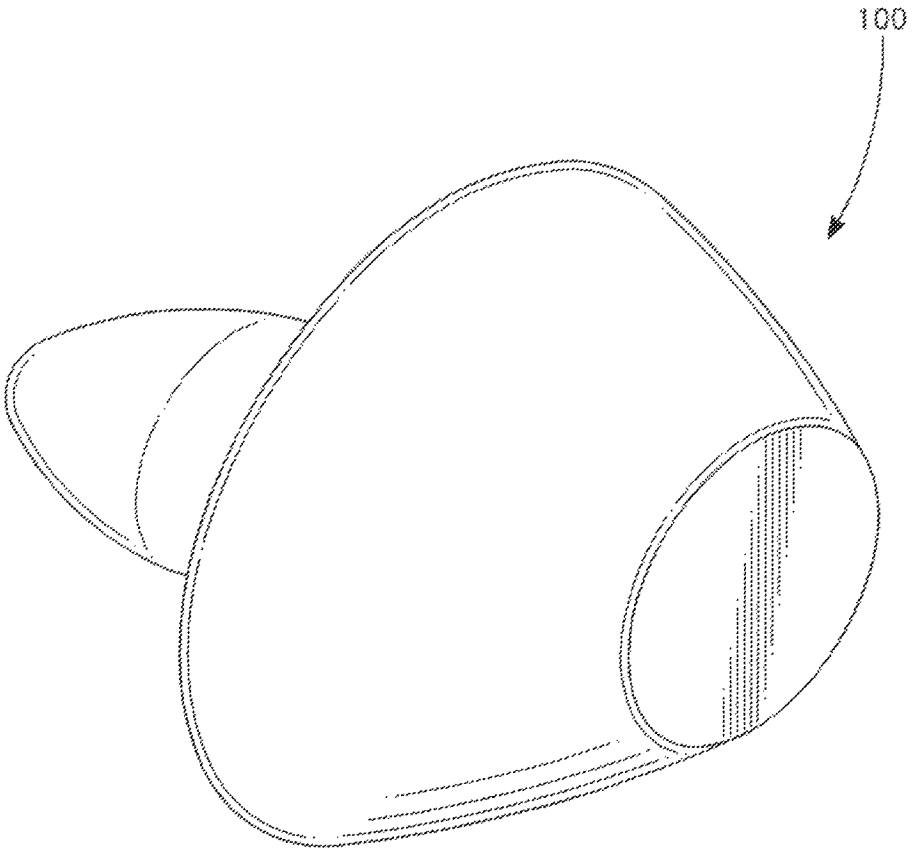
FIG. 3A is a nose end perspective view of the outgassing pad in FIG. 1, according to some embodiments of the invention.
Figure 3B:
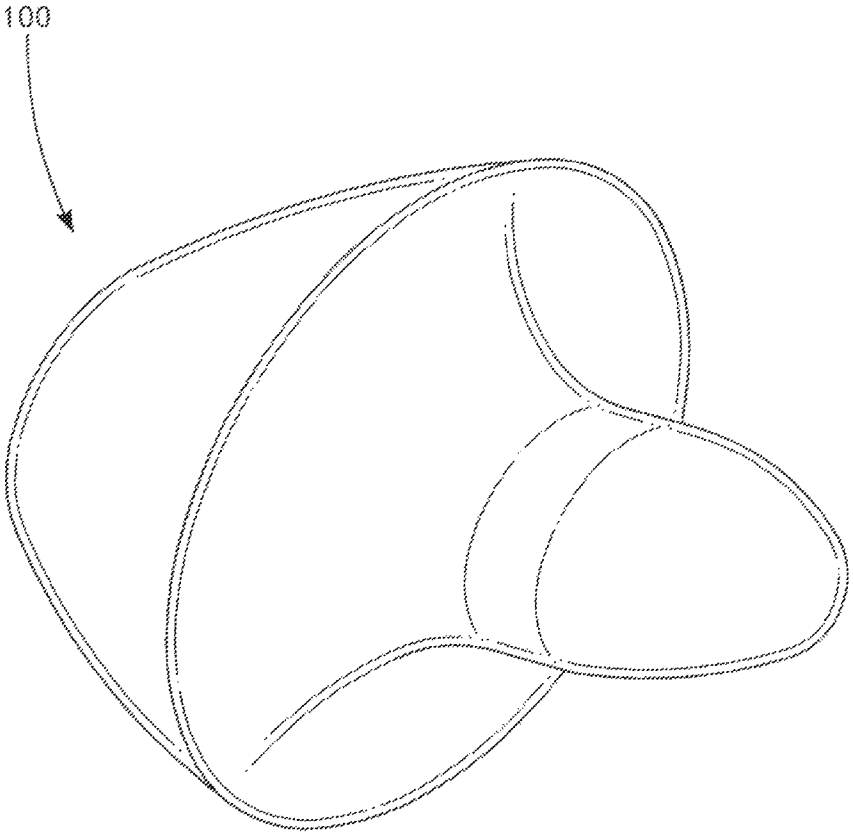
FIG. 3B is a tail end perspective view of the outgassing pad in FIG. 1, according to some embodiments of the invention.

An outgassing pad for cook-off mitigation is depicted by reference character 100 in FIGS. 1, 3A, 3B, & 5. The outgassing pad for cook-off mitigation 100 is sometimes referred to simply as an outgassing pad, pad, and the like, without detracting from the merits or generalities of embodiments of the invention. FIG. 1 is a side view of the outgassing pad 100. FIG. 11 is generic with respect to its application of an outgassing pad with a shell and an outgassing pad without a shell and, thus, is generically depicted using reference character 100. Specific section views of an outgassing pad with a shell and an outgassing pad without a shell are depicted by reference characters 100A & 100B in FIGS. 1A & 2B, respectively. As such, FIG. 2A is the section view of the outgassing pad with shell in along cut plane 2A-2A in FIG. 1. FIG. 2B is the section view of an outgassing pad without a shell along cut plane 2B-2B in FIG. 1. FIGS. 3A & 3B show the outgassing pad 100 from nose end and tail end perspective views, respectively.

Figure 4:
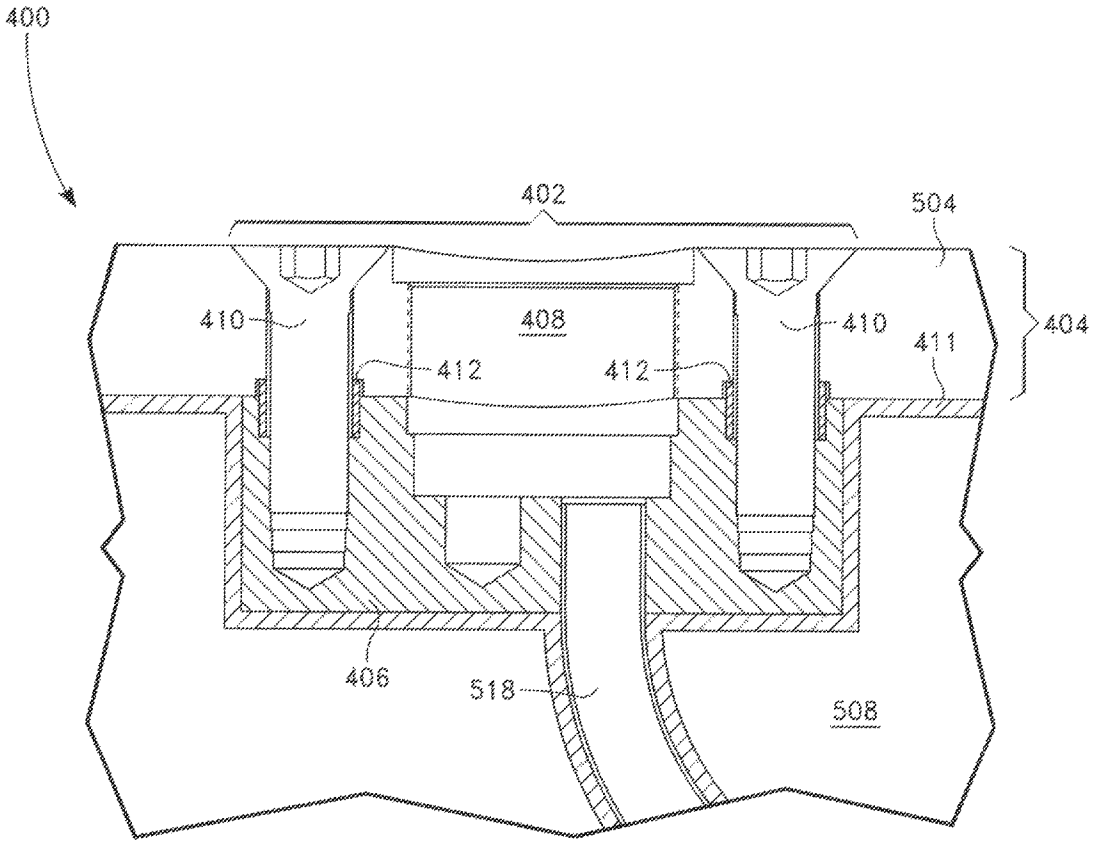
FIG. 4 a close-up of a partial section view of a charging well, according to some embodiments of the invention.
Figure 6:
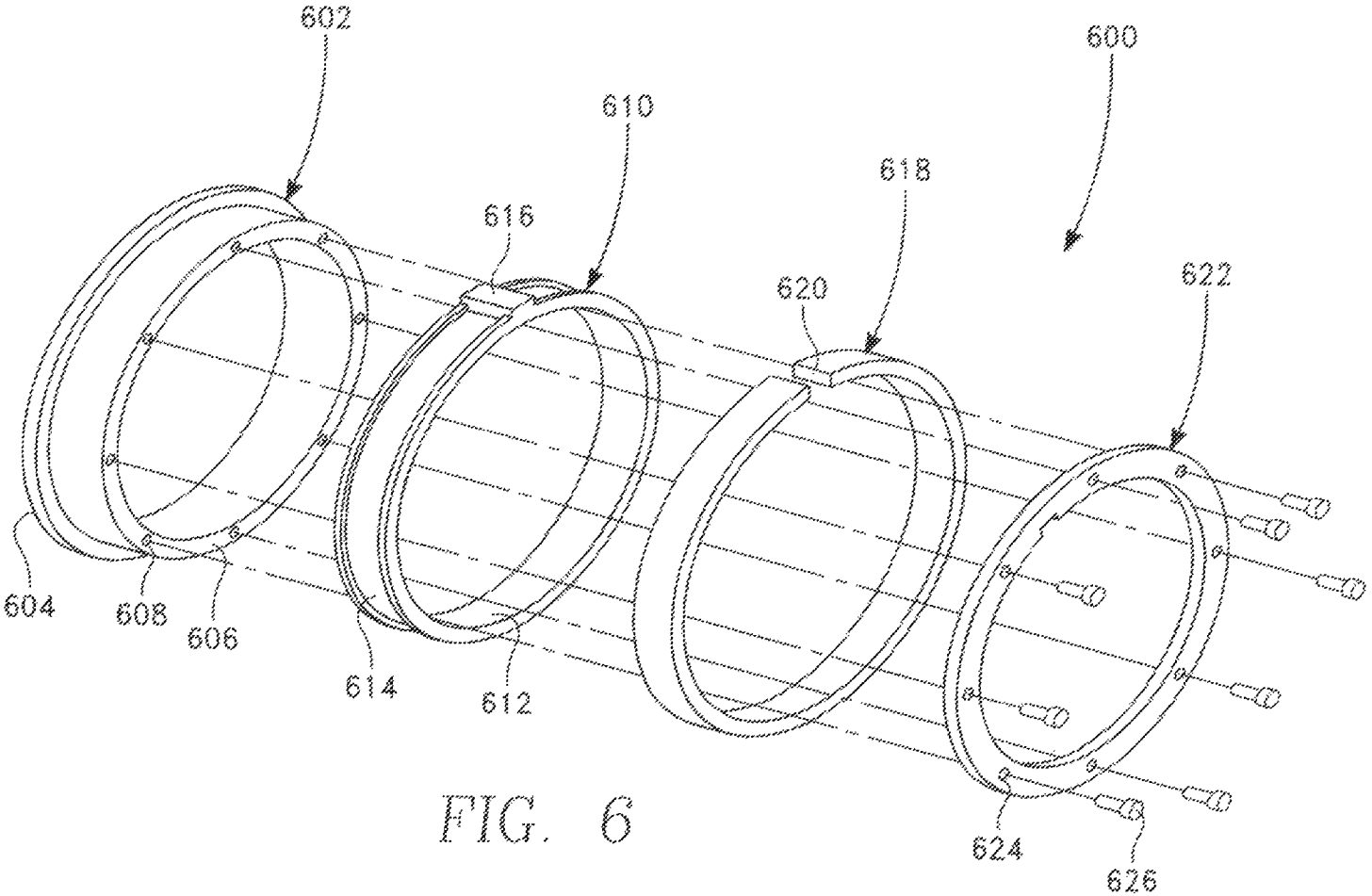
FIG. 6 is an exemplary exploded view of a eutectic device that can be used in some embodiments of the invention.

FIG. 4 is a close-up partial section view of a charging well for cook-off mitigation, as depicted by reference character 400. The charging well for cook-off mitigation 400 is sometimes referred to simply as a charging well and other similar variations, without detracting from the merits or generalities of embodiments of the invention. FIG. 5 illustrates a cook-off mitigation system 500 in a generic munition 502. FIG. 6 is an exploded view of a eutectic device 600 that can be used in some embodiments of the invention.

Referring to FIG. 2A, the outgassing pad with a shell (reference characters 100A and 102) houses an outgassing agent 104. Referring to FIGS. 1 & 5, a generic munition is depicted with reference character 502 having a munition casing 504 with an interior wall 506. The munition 502 has a nose end 503 and a tail end 505. The interior wall 506 defines an interior compartment that is configured to house an explosive fill 508. The outgassing pad 100 is positioned inside the interior compartment 506 and adjacent to the interior nose end 510 of the munition 502.

Outgassing pad 100 positioning and, therefore, the shell 102, such as in the embodiment depicted in FIG. 2A by reference character 100A, is notable because previous attempts at using an outgassing pad were, if employed at all, positioned in an aft vent and not in the nose end. Similarly, the embodiment depicted in FIG. 2B by reference character 100B is also notable for the same reason. Furthermore, previous attempts at using outgassing pads, if used at all, were flat, circular discs and not shaped as disclosed herein.

The shell 102 has at least two sides 210A & 212A, synonymous with the first and second portions mentioned above, that are diametrically-opposed to each another with one of the two sides being adjacent to the interior nose end 510 of the munition 502. Viewing FIGS. 2A & 5 simultaneously, it is readily apparent that the side depicted by reference character 210A is adjacent to the interior nose end 510 of the munition 502. The other side, depicted by reference character 212A, is adjacent to the explosive fill 508 housed in the interior compartment 506 of the munition 502. The explosive fill 508 holds the shell 102 adjacent to the interior nose end 510. Adhesive can be used, if desired, to adhere the shell 102 adjacent to the interior nose end 510.

Similarly, the outgassing pad without a shell (reference character 100B in FIG. 2B) also has at least two sides 210B & 212B, synonymous with the first and second portions mentioned above, that are diametrically-opposed to each another with one of the two sides being adjacent to the interior nose end 510 of the munition 502. Viewing FIGS. 2B & 5 simultaneously, it is readily apparent that the side depicted by reference character 210B is adjacent to the interior nose end 510 of the munition 502. The other side, depicted by reference character 212B, is adjacent to the explosive fill 508 housed in the interior compartment 506 of the munition 502. The explosive fill 508 holds the outgassing pad without a shell (reference character 100B) adjacent to the interior nose end 510. Adhesive can be used, if desired, to adhere the outgassing pad without a shell (reference character 100B) adjacent to the interior nose end 510. Additionally, the outgassing pad without a shell (reference character 100B) can be adhered to the interior wall 506 of the munition by selecting a binding agent such as, for example, asphaltic hot mix or Epolene wax, which allows for the application of the outgassing agent and binder to be applied directly to the interior wall of the munition 502 as a liner.

Referring to FIG. 4, another embodiment of the invention is directed to a charging well for cook-off mitigation and is depicted with reference character 400. The charging well 400 includes a charging well cavity 402 penetrating a munition casing 504. Some of the components are not shown in the accompanying drawings to assist with ease of view. FIG. 4 depicts the charging well cavity 402 having a top end 404 (sometimes referred to as a proximal end) and a bottom end 406 (sometimes referred to as a distal end).

The munition casing 504 has a nose end 503 and a tail end 505. The charging well cavity 402 houses a charging well component, generically depicted in FIG. 4 by reference character 408, which provides power to a munition fuze (generically depicted by reference character 513) housed in a fuze well 511 and positioned at the tail end 505. An explosive fill 508 is generically shown in FIG. 5 and is housed in the munition casing 504. The munition casing 504 is steel and has an interior protective liner 411 separating the munition casing and the charging well cavity 402 from the explosive fill 508. The fasteners 410 attach the charging well component 408 to the munition casing 504 and the bottom end 406. The fasteners 410 are plastic.

A dedicated eutectic device 412 is concentric about a corresponding fastener in the plurality of fasteners 410. The dedicated eutectic device 412 is generically shown in section view in FIG. 4. FIG. 4 depicts two dedicated eutectic devices 412 in section view, although any number can be used based on application-specific requirements. Each eutectic device 412 secures the bottom end 406 to each corresponding fastener in the plurality of fasteners 410. Each eutectic device 412 can be referred to as a securing device or as a releasable securing device or as a thermally-releasable securing device.

Figure 5A:
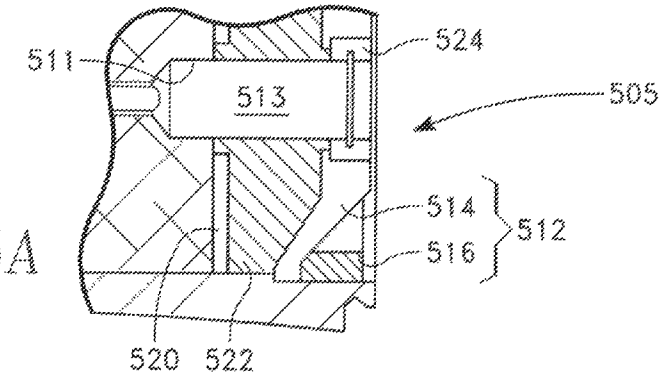
FIG. 5A is a partial cutaway section view of the tail end of the system in FIG. 5, according to some embodiments of the invention.

FIGS. 5 & 5A depict another embodiment of the invention. A cook-off mitigation system 500 in a generic munition 502 is shown. In particular, the system includes the outgassing pad 100, the charging well 400 and associated components discussed previously. The charging well 400 and associated components are electrically-connected to the fuze well 511 to provide power to a munition fuze 513 that is housed in the fuze well, and shown generically for ease of viewing. As depicted in FIG. 5, the charging well 400 is located (positioned) at about the midpoint (middle) of the munition 502, which is about halfway between the nose end 503 and tail end 505. As discussed above, the plurality of fasteners 410 attach the charging well 400 and associated components to the munition casing 504. A releasable tail closure mechanism 512 (depicted in FIG. 5A) is attached to the tail end 505 of the munition casing 504 and is configured to house an explosive fill 508 in the interior compartment 506.

FIG. 5A is a partial cutaway section view of the tail end of the system in FIG. 5. The releasable tail closure mechanism 512 has a base plug 514 that is concentric about the fuze well 511 and is attached to the munition casing 504. The base plug 514 is steel or steel alloy. A thermally-releasable base plate 516 is concentric about the fuze well 511 and fits on the outer periphery of the base plug 514 and is attached to the base plug and the munition casing 504. The thermally-releasable base plate 516 is a eutectic device. As shown in FIG. 5A, the releasable tail closure mechanism 512 includes both the base plug 514 and the thermally-releasable base plate 516. Components depicted are dimensioned to be close-fitting and to maintain structural integrity both during storage and while in use.

FIG. 6 illustrates a eutectic device, generically depicted with reference character 600, which can be used in some embodiments of the invention, including the dedicated eutectic device(s) 412 shown in FIG. 4 and the thermally-releasable base plate 516 shown in FIG. 5A. The dedicated eutectic device(s) 412 in FIG. 4 are smaller than the thermally-releasable base plate 516 in FIG. 5A. The eutectic feature in FIG. 6 is based on U.S. Air Force venting configurations.

The eutectic device 600 is shown in an exploded view and is representative of the eutectic devices 412 & 516 shown in FIGS. 4 & 5A, respectively. The eutectic device 600 includes a hub ring 602 having a proximal side 604 and a distal side 606. The distal side has a plurality of threaded recesses 608. Suitable materials for the hub ring 602 include steel and steel alloys. A eutectic ring 610 has an inner surface 612, an outer surface 614, and a rib 616 on its outer surface. The inner surface 612 of the eutectic ring 610 is concentric about the hub ring 602. Suitable materials for the eutectic ring 610 include metal alloys having about 58 percent bismuth (Bi) and about 42 percent tin (Sn). The eutectic ring 610 composition is tuned to a desired aft closure release temperature. Adjusting the percentages may change the melt temperature, which may allow for tuning of the desired release. Thus, in some embodiments, the bismuth (Bi) composition may be about 50 to 60 percent and the tin (Sn) composition is about 40 to 50 percent, depending on the desired release temperature.

A spring ring 618 is concentric about the eutectic ring 610. The spring ring 618 has a slot 620 that is dimensioned to engage the rib 616 on the eutectic ring 610. Suitable materials for the spring ring 618 include steel and spring back steel. The rib 616 and slot 620 engagement prevents axial movement of the spring ring 618 about the eutectic ring 610. A retainer ring 622 has a plurality of apertures 624 that are thru-holes in the retainer ring. Suitable materials for the retainer ring 622 include steel. When assembled, the retainer ring 622 is abutted against the hub ring 602, the eutectic ring 610, and the spring ring 618. A plurality of screws 626 fasten the retainer ring 622, the spring ring 618, the eutectic ring 610, and the hub ring 602 together by being inserted through the plurality of apertures 624, through the retainer ring 622, and into the plurality of threaded recesses 608 on the distal side 606 of the hub ring 602. The screws 626 can be steel or steel alloy cap screws.

Theory of Operation

Outgassing pad 100 positioning in the interior nose end 510 in conjunction with the defined geometry, described herein, aids in containing decomposition products to more effectively control the expulsion of explosive billet 508 out of the munition 502 after the release of the tail closure mechanism 512. Less outgassing agent 104 can be used and provides for a more focused outgassing environment. Outgassing agent 104 quantity can change due to the quantity of gases needed to expel the explosive billet 508. Additionally, positioning the outgassing pad 100 in the nose end 503 of the munition 502 reduces the risk of shock initiation of the explosive fill 508 in hard target penetration munitions.

The outgassing pad 100 location, geometry, and outgassing agent 104 selection is based on the anticipated gaseous products and reaction temperature for a specific munition. Employing an elastomeric shell 102 allows contained expansion and uniform pressure upon the explosive billet 508 until the elastomeric shell ruptures. Decomposition of the outgassing agent 104 occurs prior to reaction of the explosive fill (at a temperature range of about 280 degrees F. to about 320 degrees F. for some explosive fills and about 280 degrees F. to 350 degrees F. for other explosive fills.

The selected shape of the outgassing pad 100 is such that it expands as a wedge and obturates the explosive fill 508. One having ordinary skill in the art will recognize that obturate is a term for sealing by expanding. Thus, the outgassing pad 100 expands as a wedge and further expands the portion of the explosive billet 508 at the interior nose end 510 against the interior wall 506, further sealing the expanding gas at rupture. Silicone is used for the elastomeric shell 102 to allow for contained expansion at elevated temperatures and uniform pressure upon the explosive billet 508 until the elastomeric shell ruptures.

To avoid possible detrimental fragmentation effects to the nose end 503 of the munition 502, the outgassing pad 100 and, especially the elastomeric shell 102, can also contain fragmentation control patterns to contour the explosive charge and influence preferential fragmentation. With the internal pressure created by the outgassing agent 104, the explosive billet 508 can be expelled from the munition 502 using the releasable tail closure mechanism 512 prior to ignition of the explosive billet. Thermal release of the eutectic devices 412 & 516 occurs at a range of about 280 degrees F. to about 320 degrees F. This allows the explosive billet 508 to burn totally unconfined, thus producing a passing reaction by reducing the severity of the munition reaction to standardized IM cook-off testing, often referred to as slow cook-off (SCO) and fast cook-off (FCO). The cook-off temperatures are greater than the munition's operational temperatures. One skilled in the art will recognize that insensitive munitions testing includes identifying the system's response to standardized testing. Munitions responses are assessed depending on multiple variables and an acceptable reaction, sometimes referred to as a passing reaction or passing test.

The charging well 400 is configured to remain functional at operational temperatures but weaken at cook-off temperatures, allowing for the unimpeded expulsion of the explosive billet 508. The eutectic device 412 prevents the charge well bottom 406 from moving when the munition 502 impacts a target but will soften and/or melt before the outgassing pad 100 outgasses. Likewise, the plastic fasteners 410 retain the charge well bottom 406 during most of the munition's lifecycle but also soften and melt during a cook-off event, allowing the charge well bottom to move laterally to the tail end 505 with the explosive billet 508 when the outgassing pad 100 outgasses. Thus, the charging well 400 is configured to release during a cook-off event and, therefore, not limit the lateral movement of the explosive billet 508. The release of the charging well 400 will concurrently release the conduit 518, when used, while the explosive billet 508 is moving laterally from the nose end 503 through the tail end 505, as the eutectic devices 412 & 516 thermally release. In an alternative embodiment, the charging well 400 and, hence, the charging well cavity 402 does not penetrate the interior wall of the munition 502. In those instances, the conduit 518 will still release to ensure that the explosive billet 508 is expelled as described above.

In an embodiment employing an unconfined/uncanistered outgassing pad 100B, as depicted in FIG. 2B, the outgassing pad is in direct contact with the explosive billet 508. The outgassing pad 100B is selected to be chemically compatible with the explosive billet 508. As with the embodiment employing a shell 102, the unconfined/uncanistered outgassing pad 100B generates gas. The generated gas is applied to the explosive billet 508 and the release process described above occurs and the explosive billet is expelled.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A cook-off mitigation system, comprising:

a munition having a nose end, a tail end, and a munition casing;

an explosive fill housed in said munition casing;

a fuzewell attached to said tail end of said munition casing, said fuzewell housing a fuze;

a charging well cavity penetrating said munition casing, said charging well cavity having a top end and a bottom end;

a charging well component attached inside said charging well cavity, said charging well component electrically-connected to said fuze;

wherein said charging well component is attached to said munition casing by a plurality of fasteners; and a dedicated eutectic device concentric about a corresponding fastener in said plurality of fasteners, wherein each of said dedicated eutectic device secures said bottom end to each corresponding fastener in said plurality of fasteners;

wherein said dedicated eutectic device is thermally-releasable and is configured to soften and melt during a cook-off event, said softening and melting causing said bottom end to release and move laterally to said tail end.

2. The system according to claim 1, wherein said munition casing has an interior protective liner separating munition casing and said charging well cavity from said explosive fill.

3. The system according to claim 1, wherein said bottom end is a structural material selected from the group of structural materials consisting of steel, aluminum, and plastic.

4. The system according to claim 1, wherein each fastener in said plurality of fasteners attach said charging well component to said bottom end.

5. The system according to claim 1, wherein said plurality of fasteners are plastic.

6. The system according to claim 1, wherein said lateral movement of said bottom end to said tail end concurrently releases said electrical connection between said charging well component and said fuze.

7. A cook-off mitigation system in a munition, comprising:

a munition casing having at least one interior compartment, a nose end, and a tail end;

wherein said at least one interior compartment is configured to house at least one explosive fill;

an outgassing pad inside said at least one interior compartment and positioned at said nose end;

a charging well cavity penetrating said munition casing, said charging well cavity having a top end and a bottom end;

a fuzewell attached to said tail end of said munition casing;

a munition fuze housed inside of and attached to said fuzewell;

a charging well component attached inside said charging well cavity, said charging well component electrically-connected to said fuze, said charging well component attached to said munition casing by a plurality of fasteners; and a releasable tail closure mechanism attached to said tail end of said munition casing, said releasable tail closure mechanism configured to contain said at least one explosive fill in said interior compartment.

8. The system according to claim 7, wherein said munition casing is steel.

9. The system according to claim 7, wherein said munition casing has an interior protective liner separating said munition casing, said charging well cavity, and said releasable tail closure mechanism from said at least one explosive fill.

10. The system according to claim 7, wherein said bottom end is a structural material selected from the group of structural materials consisting of steel, aluminum, and plastic.

11. The system according to claim 7, wherein each fastener in said plurality of fasteners attach said charging well component to said bottom end.

12. The system according to claim 7, wherein said plurality of fasteners are plastic.

13. The system according to claim 7, wherein a dedicated eutectic device is concentric about a corresponding fastener in said plurality of fasteners, wherein each of said dedicated eutectic device secures said bottom end to each corresponding fastener in said plurality of fasteners.

14. The system according to claim 7, said releasable tail closure mechanism, further comprising:

a base plug concentric about said fuzewell and attached to said munition casing; and a releasable base plate concentric about said fuzewell, said releasable base plate attached to said base plug and said munition casing.

15. The system according to claim 14, wherein said releasable base plate is a eutectic device.

* * * * *